US006325343B1

(12) United States Patent
Flagg

(10) Patent No.: US 6,325,343 B1
(45) Date of Patent: Dec. 4, 2001

(54) COMBINATION FOLDABLE AND SEPARABLE LECTERN APPARATUS

(76) Inventor: Rodger H. Flagg, 7411 Gary St., Springfield, VA (US) 22150

( * ) Notice: Subject to any disclaimer, the term of this patent is extended or adjusted under 35 U.S.C. 154(b) by 0 days.

(21) Appl. No.: 09/639,791

(22) Filed: Aug. 17, 2000

(51) Int. Cl.[7] ..... A45D 19/04
(52) U.S. Cl. ..... 248/174; 248/459; 248/460
(58) Field of Search ..... 248/174, 441.1, 248/459, 460; 312/239, 258, 259

(56) References Cited

U.S. PATENT DOCUMENTS

| | | | | |
|---|---|---|---|---|
| 4,484,787 | * | 11/1984 | Stephens | 312/239 |
| 4,760,928 | * | 8/1988 | Bustos | 248/174 X |
| 4,991,804 | * | 2/1991 | Iannucci | 248/174 |
| 5,315,935 | * | 5/1994 | Weisenfels | 248/460 X |
| 5,443,168 | * | 8/1995 | Dyment et al. | 248/174 X |
| 5,480,119 | * | 1/1996 | Fish et al. | 248/460 |
| 5,755,423 | * | 5/1998 | Michela | 248/459 |

* cited by examiner

*Primary Examiner*—Ramon O. Ramirez
(74) *Attorney, Agent, or Firm*—Rodger H. Flagg

(57) ABSTRACT

A combination foldable and separable lectern apparatus, which comprises at least seven foam panels. The right side of the second foam panel is pivotally secured to the left side of the first foam panel with a hinge means. The left side of a third foam panel is pivotally secured to the right side of the first foam panel with a hinge means. The lower side of a fourth foam panel is optionally pivotally secured to the upper side of the first foam panel with a hinge means. The right side of a fifth foam panel is pivotally secured to the left side of the fourth foam panel with a hinge means, and the left side of a sixth foam panel is pivotally secured to the right side of the fourth foam panel with a hinge means. A releasable securement means is used to releasably secure the respective fifth and sixth foam panels to the respective second and third foam panels A seventh foam panel forms a top platform extending between the upper inclined portion of the fifth and sixth foam panels, and is releasably secured thereto with a releasable securement means. An optional eighth foam panel may form a shelf extending between the second and third foam panels. The foam panels may be covered with a material selected from paper, cloth or plastic on at least one surface to improve appearance of the foam panels. The foam panels may be assembled into a table assembly, a stand-up lectern assembly, or a tabletop lectern assembly, to suit the needs of the user. The foam panels are placed into a lectern carrying case for ease of transport or storage.

20 Claims, 4 Drawing Sheets

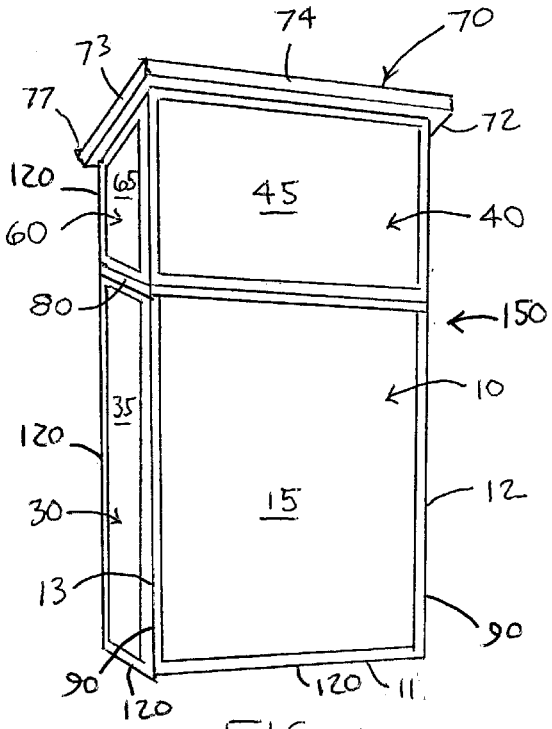
FIG. 1
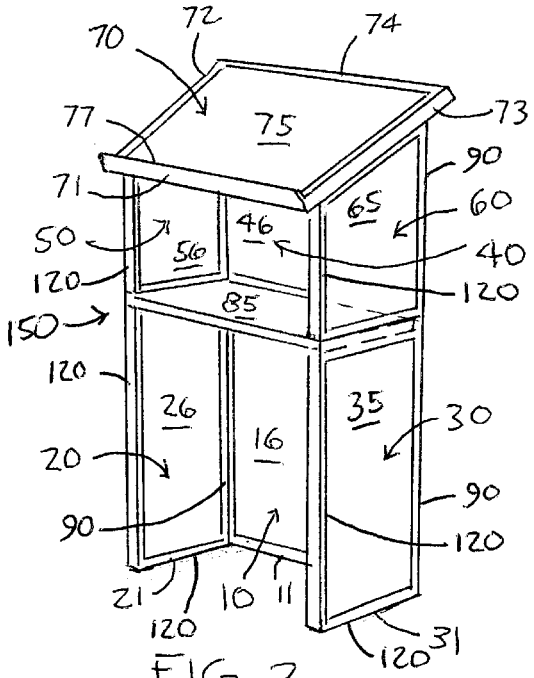
FIG. 2
FIG. 3
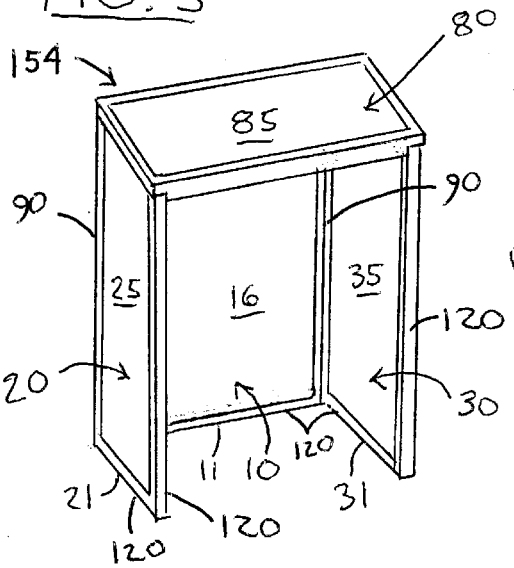
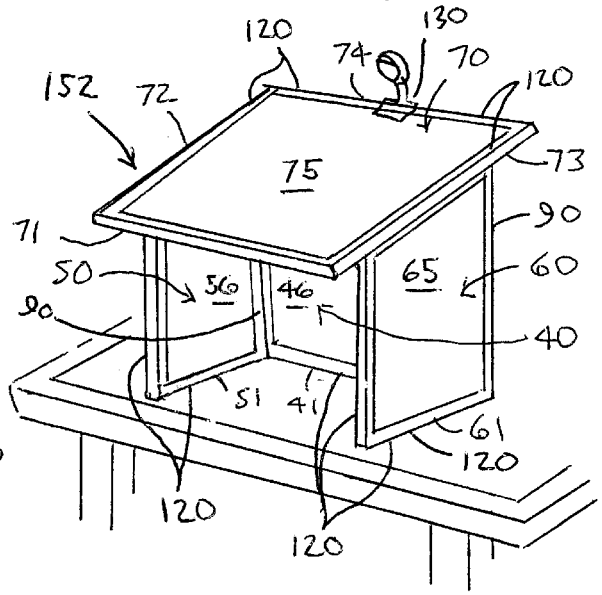
FIG. 4

COMBINATION FOLDABLE AND SEPARABLE LECTERN APPARATUS

FIELD OF THE INVENTION

The present invention relates of lecterns for public speaking, and more specifically to a combination foldable and separable lectern that may be selectively configured as a standup lectern assembly, a table top lectern assembly or as a table assembly, and is lightweight, and easy to transport, setup and store.

BACKGROUND OF THE INVENTION

Lecterns are commonly used to provide a supporting surface for books, documents and papers for a speaker while giving a speech, presentation, or talk to an audience. Lecterns are sometimes called podiums. The speaker typically stands behind the lectern, so the standup lectern must be high enough to support documents at a suitable height for reading or viewing while standing. Standup lecterns known in the prior art are typically large and bulky, which makes them difficult to move and store between use. When speaking to a group seated about a table, a tabletop lectern is preferred. The tabletop lectern should be at a height above the table to support documents for reading or viewing while standing at the table. At times a table is needed to support a projector for viewing slides or movies. Many speakers prefer a lectern when speaking to clubs, groups, organizations, rallies, etc. Many such meetings are periodically held in hotels, restaurants, churches, schools, and other large gathering places, where a lectern is often not readily available. Lecterns may be rented when needed. This is often expensive, and takes time and planning to arrange it's arrival when needed. As a result, lecterns are not always provided to guest speakers, and the speaker must improvise as best they can.

U.S. Pat. No. 5,315,935 issuing to Weisenfels on May 31, 1994 discloses a folding portable drafting table having an inclined top and side shelf supports for a shelf. The sides fold over each-other, making one of the folded sides not adjacent to the front portion. The side shelf supports further limit the foldability of the drafting table. This wastes space during transport and storage.

U.S. Pat. No. 5,152,491 issuing to Forester et. al, on Oct. 6, 1992 discloses a reading material support, having a top portion which is adjustably positioned for height and angle between opposing sides. No provision is provided to convert the reading material support between standing and tabletop use.

U.S. Pat. No. 5,044,595 issuing to Carr on Sep. 3, 1991, discloses a collapsible podium utilizing laterally pliable, yet longitudinally rigid panels. The panels are inserted into curved slots in the top, bottom and middle portions. A slotted top and bottom portion is required in each configuration.

U.S. Pat. No. 4,618,120 issuing to Wattles on Oct. 21, 1986 discloses a portable tabletop lectern having four side panels. The side panels are slidably received in joining strips. To breakdown, all the pieces are separated. No provision is made to adapt this tabletop podium to a standup podium, or to a table.

U.S. Pat. No. 4,484,787 issuing to Stephens on Nov. 27, 1984 discloses a portable, foldable voting booth/lectern, comprising a three sided lower portion, and a four sided upper portion. The bottom of the upper portion contains a three sided groove to receive the upper edge of the lower portion. No provision is made to releasably secure the lower portions within the three sided groove.

U.S. Pat. No. 3,056,230 issuing to Brokaw Jr. on Oct. 2, 1962, discloses a portable tabletop lectern having four foldable portions, with the top inclined portion comprising multiple sheets, which may be folded to suspend over the back portion.

U.S. Design Pat. No. D215,665 issuing to Giede on Oct. 21, 1969, discloses a portable lectern having a front portion, a back portion, foldable side portions and a top portion. The sides fold inward when the top is raised, to collapse the podium. No provision is made to adapt this design to a standup podium.

U.S. Design Pat. No. D179,235 discloses a leaflet dispensing pulpit having indicia on the front face of the pulpit.

Therefore, what is needed is a combination foldable and separable light weight lectern, which may be carried where needed, is easy to quickly set up and take down, and which may be compactly stored between use. The combination foldable and separable light weight lectern may be configured as a standup lectern assembly, a table top lectern assembly, or as a table assembly, to suit the needs of the user.

SUMMARY OF THE INVENTION

The combination foldable and separable lectern apparatus comprises a plurality of foam panels which are pivotally secured together. The left side of a first foam panel is pivotally secured to the right side of a second foam panel with a hinge means. The left side of a third foam panel is pivotally secured to the right side of the first foam panel with a hinge means. The lower side of a fourth foam panel may be pivotally secured to the upper side of the first foam panel with a hinge means. The right side of a fifth foam panel is pivotally secured to the left side of the fourth foam panel with a hinge means, and the left side of a sixth foam panel is pivotally secured to the right side of the fourth foam panel with a hinge means. A releasable securement means is used to releasably secure the respective fifth and sixth foam panels to the respective second and third foam panels A seventh foam panel forms a top platform extending between the upper inclined portion of the fifth and sixth foam panels, and is releasably secured thereto with a releasable securement means. An eighth foam panel preferably forms a shelf extending between the second and third foam panels. The foam panels may be covered with a material selected from paper, cloth or plastic on at least one surface to improve appearance of the foam panels. Alternately, a finished surface may be molded into the foam panels during fabrication. The combination foldable and separable lectern apparatus may be configured to be a standup lectern, a table top lectern, or a table. A lectern cover may be used to protect the foldable and collapsible lectern apparatus during transport and storage.

BRIEF DESCRIPTION OF THE DRAWINGS

FIG. 1 is a perspective view of the foldable lectern apparatus set up for use as a standup lectern, as seen from the front side.

FIG. 2 is a perspective view of the foldable lectern apparatus set up for use as a standup lectern, as seen from the back side.

FIG. 3 is a partially folded view of the foldable lectern apparatus, serving as a table or stand, as seen from the back side.

FIG. 4 is a perspective view of the table top lectern apparatus, as viewed from the back side.

DETAILED DESCRIPTION OF THE INVENTION

As shown in FIG. 1 through FIG. 8, the combination foldable and separable lectern apparatus 100 disclosed herein, is compact, light weight, foldable, and easy to setup and take down, without the need for tools or accessories.

Referring first to FIG. 1, the lectern apparatus 100 is shown set up for use as a standup lectern 150, as seen from the front side of the standup lectern 150. FIG. 2 shows the back side of the combination foldable and separable lectern apparatus 100, when set up for use as a standup lectern 150.

Figure 5A:
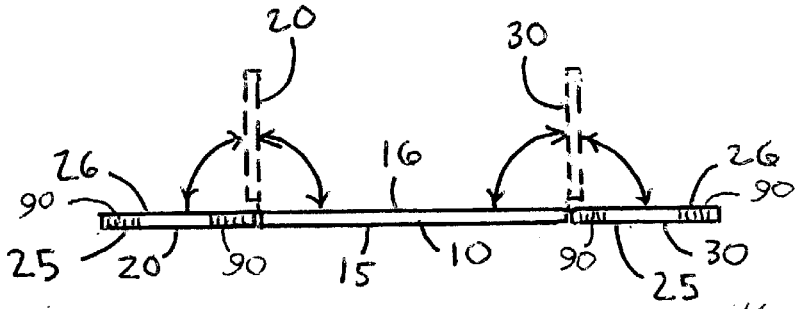
FIG. 5A is a view of the lower hinged assembly, shown in an extended position
Figure 5A:
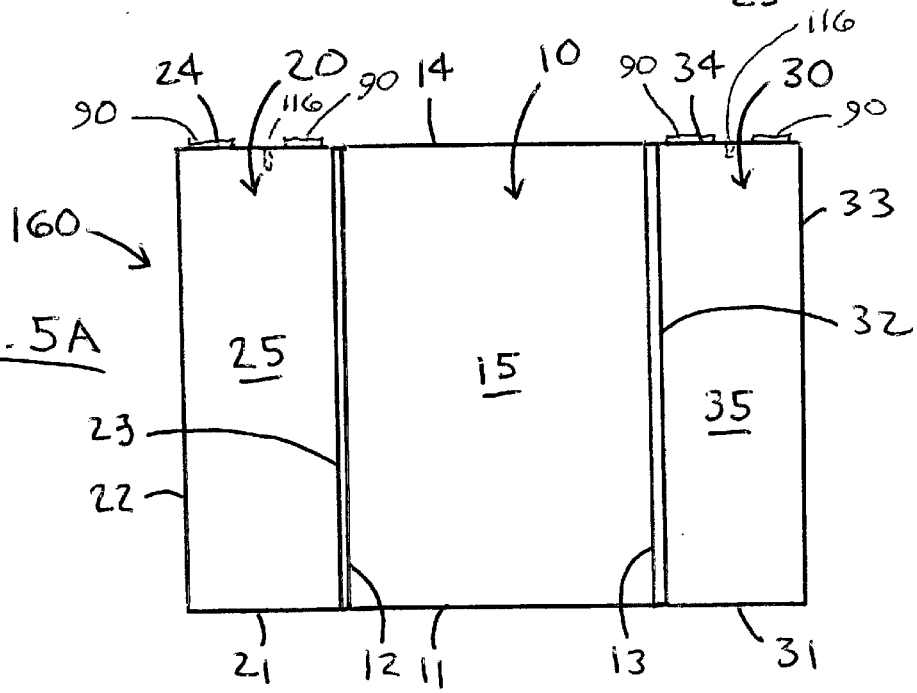

As best shown in FIG. 5A, the first foam panel 10 has a bottom side 11, a left side 12, a right side 13, an upper side 14, a front face 15 and a back face 16. The first foam panel 10 preferably has a thickness selected to be from one eighth inch thick to one inch thick. The width of the first foam panel 10 is selected to be from sixteen inches to thirty-six inches, with eighteen inches to twenty-four inches preferred. The height of the first foam panel 10 is selected to be from twenty four inches to thirty six inches high, with twenty-eight inches to thirty-two inches high being preferred.

The second foam panel 20 has a bottom side 21, a left side 22, a right side 23, an upper side 24, a front face 25 and a back face 26. The second foam panel 20 preferably has a thickness selected to be similar to the thickness of the first foam panel 10. The width of the second foam panel 20 is selected to be not more than one-half the width of the first foam channel. The height of the second foam panel 10 is preferably substantially equal to, or up to one inch less than the height of the first foam panel.

The third foam panel 30 has a bottom side 31, a left side 32, a right side 33, an upper side 34, a front face 35 and a back face 36. The third foam panel 30 preferably has a thickness selected to be similar to the thickness of the first foam panel 10. The width of the third foam panel 30 is selected to be not more than one half the width of the first foam channel, so that the second and third foam panels 20, 30 may be folded side by side adjacent to the back face 16 of the first foam panel 10. The height of the second foam panel 10 is preferably substantially equal to, or up to one inch less than the height of the first foam panel.

The left side 12 of the first foam panel 10 is pivotally secured to the right side 23 second foam panel 20 with a hinge means 90, and the right side 13 of the first foam panel is pivotally secured to the left side of the third foam panel 30 with a hinge means 90, to form a lower hinged sub-assembly 160

Figure 5B:
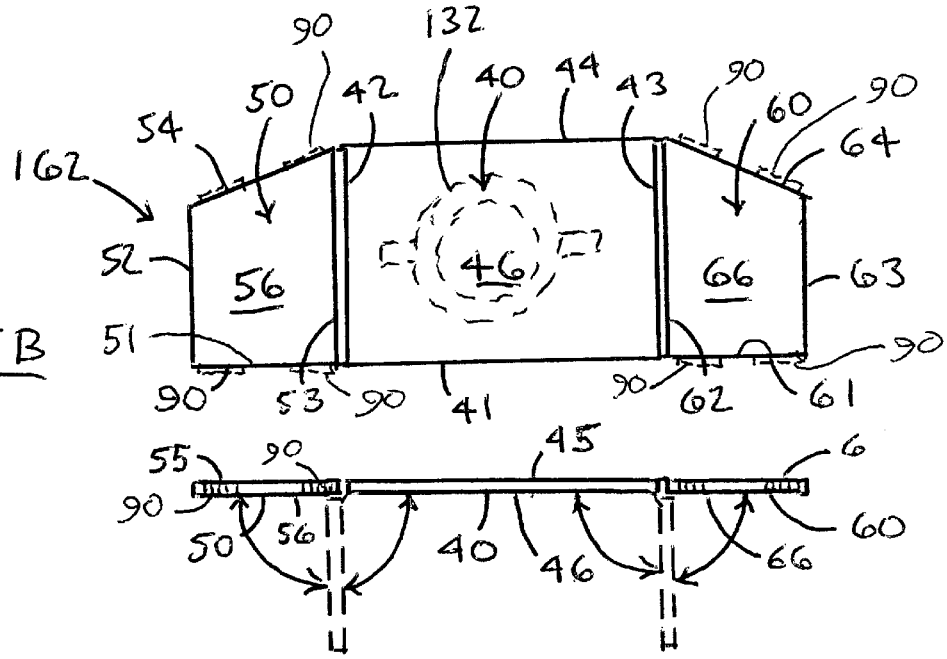
FIG. 5B is a view of the upper hinged assembly, shown in an extended position.

As best shown in FIG. 5B, the fourth foam panel 40 has a bottom side 41, a left side 42, a right side 43, an upper side 44, a front face 45 and a back face 46. The fourth foam panel 40 preferably has a thickness similar to the thickness of the first foam panel 10. The width of the fourth foam panel 40 is preferably the width of the first foam panel 10. The height of the fourth foam panel 40 is selected to be from twenty four inches to thirty six inches high, with twenty-eight inches to thirty-two inches preferred.

The fifth foam panel 50 has a bottom side 51, a left side 52, a right side 53, an inclined upper side 54, a front face 55 and a back face 56. The fifth foam panel 50 preferably has a thickness selected to be similar to the thickness of the first foam panel 10. The width of the fifth foam panel 50 is selected to be slightly less than one-half the width of the fourth foam panel 40. The height of the fifth foam panel 50 is preferably to be substantially the height of the fourth foam panel 40, with the inclined top portion 54 extending downwardly from the height of the fourth foam panel 40 from one to ten inches, with two to five inches preferred.

The sixth foam panel 60 has a bottom side 61, a left side 62, a right side 63, an inclined upper side 64, a front face 65 and a back face 66. The sixth foam panel 60 preferably has a thickness selected to be similar to the thickness of the first foam panel 10. The width of the sixth foam panel 60 is preferably selected to be slightly less than one half the width of the fourth foam channel, so that the fifth and sixth foam panels 50, 60 may be folded side by side adjacent to the back face 46 of the fourth foam panel 40. The height of the sixth foam panel 60 is preferably substantially the height of the fourth foam panel 40, with the inclined upper side 64 extending downwardly from the height of the fourth foam panel 40 from one to ten inches, with two to five inches preferred.

The left side 42 of the fourth foam panel 40 is pivotally secured to the right side 53 fifth foam panel 20 with a hinge means 90, and the right side 43 of the fourth foam panel is pivotally secured to the left side 62 of the sixth foam panel 60 with a hinge means 90, to form an upper hinged sub-assembly 162

Figure 5C:
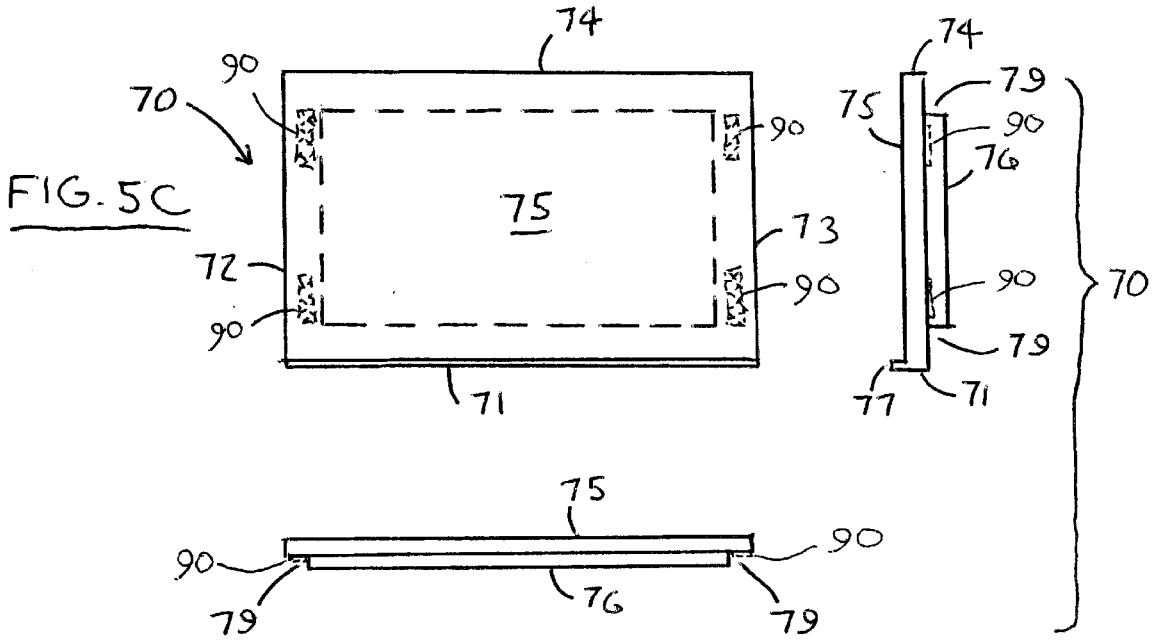
FIG. 5C is a view of the seventh foam panel, showing an offset edge.

As best shown in FIG. 5C, a seventh foam panel 70 has a front side 71, a left side 72, a right side 73, a back side 74, an upper surface 75 and a lower surface 76. The upper surface 75 of the seventh foam panel serves as a top platform surface 77 for the lectern apparatus 100. The width of the seventh foam panel 70 is selected to be at least the width of the inclined top surface 64 of the sixth foam panel 60, and is preferably from eleven inches to eighteen inches wide. The length of the seventh foam panel 70 is at least the width of the fourth foam panel 50 plus twice the thickness of the fifth foam panel 50. The overall length of the seventh foam panel 70 is preferably from twenty to thirty inches long. The thickness of the seventh foam panel 70 is preferably from one to three times the thickness of the first foam panel 10. The extra thickness of the seventh foam panel 70 increases the strength and rigidity of the seventh foam panel 70. A lower offset ledge 78 may be used to abut the inner face 56, 66 of the inclined top side 54, 64 of the fifth and sixth foam panels 50, 60.

Figure 5D:
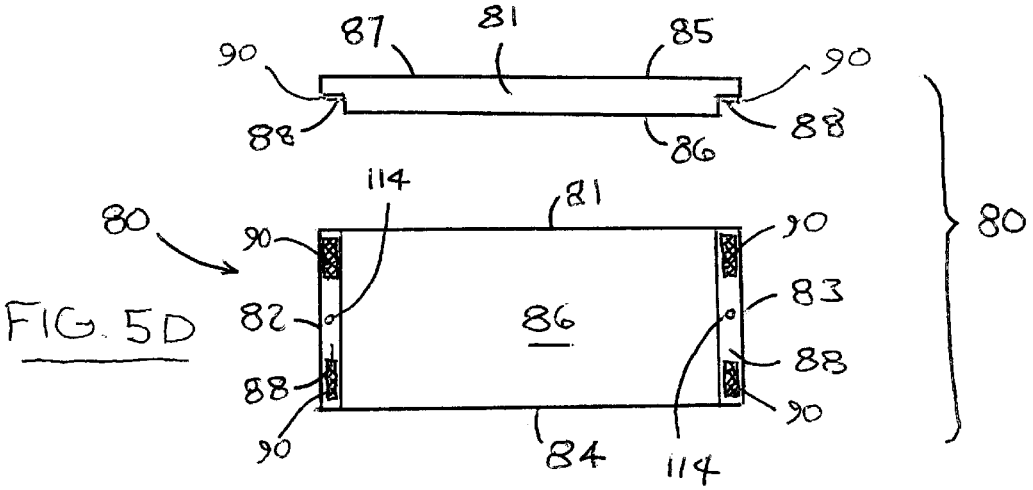
FIG. 5D is a view of the eighth foam panel, showing an offset edge.

As shown in FIG. 5D, an optional eighth foam panel 80 has a front side 81, a left side 82, a right side 83, a back side 84, an upper surface 85 and a lower surface 86. When an eighth foam panel 80 is used as a horizontal shelf 87, the height of the second and third foam panels 20, 30 is preferably reduced by the thickness of the eighth foam panel 80, so that the upper surface 85 of the eighth foam panel is aligned with the upper side 14 of the first foam panel 10. The thickness of the eighth foam panel 80 is preferably from one to three times the thickness of the first foam panel 10. The extra thickness of the eight foam panel 80 increases the strength and rigidity of the horizontal shelf 87. A lower offset ledge 88 may be used to abut the inner face 26, 36 of the second and third foam panels 20, 30 in proximity to the upper sides 24, 34 of the second and third foam panels 20, 30. Likewise an upper offset ledge 89 may also be used to abut the inner face 56, 66 of the fifth and sixth foam panels in proximity to the lower sides 51, 61 of the fifth and sixth foam panels 50, 60.

When used, the lower offset ledge 88, serves to align the left and right sides of the shelf 87 in relation to the left and right outer faces 25, 35 of the second and third foam panels. Likewise the upper offset ledge 89, serves to align the left and right sides 82, 83 of the shelf 87 in relation to the left and right outer faces 55, 65 of the fifth and sixth foam panels.

A releasable fastening means 90 is preferably used to releasably secure the left side 82 of the eighth foam panel 80 to the top side 54 of the second foam panel 50. The releasable fastening means 90 is preferably a hook and loop type fastener. Likewise, a releasable fastening means 90 is also used to secure the right side 83 of the eighth foam panel 80 to the top side 34 of the third foam panel 60. The shelf 87 thus formed serves as a horizontal support for books, papers, purse, or other paraphernalia used by speakers when giving speeches to an audience. The shelf 87 serves as a horizontal stiffening support for the standup lectern assembly 150, and a top portion for the table assembly 160.

A releasable fastening means 90, such as hook and loop type fasteners, are used to releasably secure the left side 82 of the eighth foam panel 80 to the bottom side 51 of the fifth foam panel 50. Likewise, a releasable fastening means 90 is used to releasably secure the right side 83 of the eighth foam panel 80 to the bottom side 61 of the sixth foam panel. Additional releasable fastening means 90 are used to releasably secure the left side 72 of the seventh foam panel 70 to the inclined top side of the fifth foam panel 50, and the right side 73 of the seventh foam panel 70 to the inclined top side 64 of the sixth foam panel 60.

One or more alignment pins 114 may be used to align the top side 24, 34 of the second and third foam panels 20, 30 with the bottom side 86 of the eighth foam panel 80. Likewise, one or more alignment pins 114 may be used to align the bottom side 54, 64 of the fifth and sixth panels with the top side of the 85 of the eighth foam panel 80. When used, a complimentary alignment aperture 116 is provided to receive the alignment pin 114.

Figure 6:
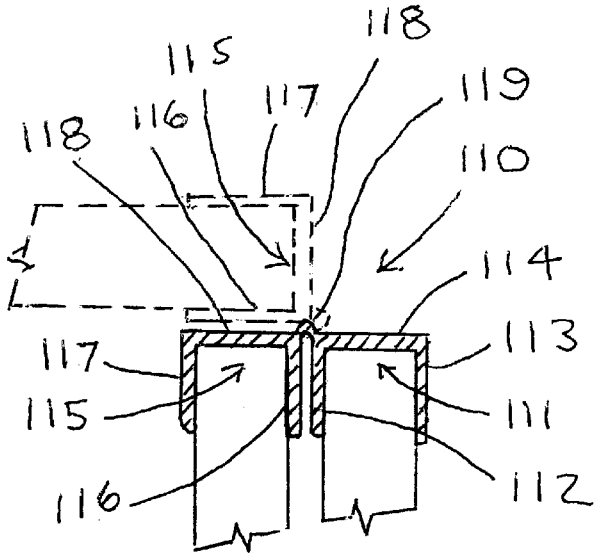
FIG. 6 is a sectional view of the of the preferred hinge means, showing the folded position in solid lines, and the extend position in dashed lines.

As best shown in FIG. 6, the hinge means 110 is preferably made of a molded, extruded or formed plastic material having a first U-shaped groove 111 formed between a first depending side 112 and a second depending side 113, located in spaced parallel alignment, with a first top-portion 114 extending between the first and second depending sides 112, 113.

A second U-shaped groove 115 is formed by a third depending side 116, and a fourth depending side 117 in spaced parallel alignment, with a second top portion 118 extending between the third and fourth depending sides 116, 117. The first and second U-shaped grooves 111, 115 are joined at their respective first and third depending sides 112, 116 by a pivoting member 119. The pivoting member 119 is preferably a living hinge, although any known hinge means 110 may be used, and such use is intended to fall within the scope of this disclosure, and of the following claims.

In the extended position shown in dashed line in FIG. 6, the hinge means 110 positions the first and second top portions 114, 118 adjacent to each other in substantially parallel alignment, while the first and third depending side portions 112, 116 are in substantially liner alignment.

In the folded position shown in solid line in FIG. 6, the foldable hinge means 110 is flexed to position the first and third depending side portions 112, 116 of the hinge means 110 adjacent to each other in substantially parallel alignment, while the first and second top portions 114, 118 of the hinge means 100 are positioned in substantially perpendicular (right angle) alignment.

The first and second foam panels 10, 20, are pivotally secured between extended and folded positions about a vertically disposed hinge means 110. Likewise, the second and third foam panels 20, 30 are pivotally secured between extended and folded positions about a vertically disposed hinge means 110. The first, second, and third foam panels 10, 20, 30 thus form a lower hinged sub-assembly 160, as shown in FIG. 5A.

The fourth and fifth foam panels 40, 50, are pivotally secured between extended and folded positions about a vertically disposed hinge means 110. Likewise, the fourth and sixth foam panels 40, 60 are pivotally secured between extended and folded positions about a vertically disposed hinge means 110. The fourth, fifth and sixth foam panels 40, 50, 60 thus form an upper hinged sub-assembly 162, as shown in FIG. 5B.

In the extended standup lectern assembly 150 shown in FIG. 1 and FIG. 2, the fourth foam panel 40 is positioned directly above the first foam panel 10, with the front face 15 of the first foam panel 10 in linear alignment with the front face 45 of the fourth foam panel 40. The top side 14 of the first foam panel 10 is secured with a releasable fastening means 110 to the bottom side 51 of the fifth foam panel 50, and the top side 34 of the third foam panel 30 is secured with a releasable fastening means 110 to the bottom side 61 of the sixth foam panel 60.

Alternately, where an eighth foam panel 80 is used, as shown in FIG. 2 and FIG. 3, the top side 14 of the first foam panel 10 is secured with a releasable fastening means 110 to the left side 82 of the eighth foam panel 80, and the top side 34 of the third foam panel 30 is secured with a releasable fastening means 110 to the right side 83 of the eighth foam panel. The bottom side 51 of the fifth foam panel 50 is then secured with a releasable fastening means 110 to the left side of the eighth foam panel 80, and the bottom side 61 of the sixth foam panel 60 is then secured with a releasable fastening means 110 to the right side of the eighth foam panel.

In the extended position, the second and third foam panels 20, 30 are positioned substantially perpendicular (at right angles) to the first foam panel 34, and in the folded position the second and third foam panels 20, 30 are folded adjacent to the back face 16 of the first foam panel 10. The first, second and third panels 10, 20, 30 thus form the lower hinged sub assembly 160.

In the extended position, the fifth and sixth foam panels 50, 60 are positioned substantially perpendicular (at right angles) to the fourth foam panel 40, and in the folded position the fifth and sixth foam panels 50, 60 are folded adjacent to the back face 46 of the fourth foam panel 40. The fourth, fifth and sixth foam panels 40, 50, 60 thus form the upper hinged sub assembly 162.

The combined height of the first and fourth foam panels 10, 40 are selected to be from thirty six inches to forty eight inches, with forty inches to forty-four inches being preferable. This height allows a speaker to stand upright behind the standup lectern assembly 150, and position papers upon the seventh foam platform 70 for easy viewing.

Preferably, as shown in FIGS. 1 through FIG. 4, the bottom side 11 of the first foam panel 10 is enclosed within a groove 121 located in a U-shaped channel 122 The U-shaped channel 122 is preferably made of a molded, extruded or formed plastic material, sized to closely receive the bottom side 11 of the first foam panel 10 within the groove 121. Alternately, a light weight metal U-shaped channel 122 may also be used. The bottom side 11 of the first foam panel 10 is preferably adhesively secured within the groove 121, although any known fastening means may be used, without departing from the scope of this disclosure, or from the following claims.

Figure 8:
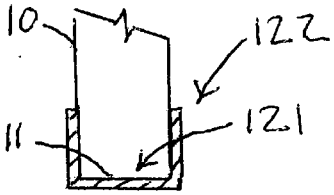
FIG. 8 is a cross sectional view of the U-shaped channel used to stiffen the edges of the foam panels.

Likewise, the bottom side 21, left side 22 and top side of the second foam panel 20, the bottom side 31, right side 33, and top side 34 of the third foam panel 30; the top side 44 of the fourth foam panel 40; the bottom side 51; the left side, and the inclined top side 54 of the fifth foam panel 50; the bottom side 61, right side 63 and inclined top side of the sixth foam panel 60; the left side 72, right side 73 and back side 74 of the seventh foam panel 70, and the left side 82, right side 83 and back side 84 of the eight foam panel are each secured within a groove 121 located in a U-shaped channel 122, as shown in FIG. 8.

As previously noted, The U-shaped channel 122 is preferably made of a molded, extruded or formed plastic material, sized to closely receive the bottom side 11 of the first foam panel 10 within the groove 121. Alternately, a light weight metal U-shaped channel 122 may also be used. The U-shaped channel 122 protects the exposed sides and comers of the lectern apparatus 100, and further provides additional rigidity to the foam panels 10, 20, 30, 40, 50, 60, 70, 80. The U-shaped channel 122 further provides a rigid surface for mounting the releasable fastening means 110.

The foam panels 10, 20, 30, 40, 50, 60, 70, 80, are lightweight, and preferably each has a paper, fabric or plastic finished surface 108, bonded to the front face 15, 25, 35, 45, 55, 65, 75, 85 of the respective foam panels 10, 20, 30, 40, 50, 60, 70, 80, to provide an attractive appearance. The back face 16, 26, 36, 46, 56, 66, 76, 86 of the respective foam panels 10. 20, 30, 40, 50, 60, 70, 80 may also be covered with a paper, fabric or plastic finished surface bonded thereto, if desired.

Alternately, the foam panels 10, 20, 30, 40, 50, 60, 70 and 80 may be molded with a finished front face and/or finished back face during in the molding process. The finished face may be textured as well as colored during the molding process, in a manner well known in the art. One such example is heating the mold to form a finished, textured mold surface.

The speaker side 71 of the seventh foam panel 70 preferably has a ridge 77 positioned above the top face 74 to keep pencils, markers, papers, books and other paraphernalia from rolling or sliding off the inclined top surface, as shown in FIG. 2.

One or more optional brackets 130 may be releasably secured to the top platform, to releasably secure a microphone or a light thereto. When used, the light is preferably shielded with a hood to focus the light not in the speakers eyes, but upon the upper surface of the top platform.

To set up the foldable lectern apparatus 10, the folded panels 10, 20, 30, 40, 50, 60, 70 and 80 are removed from the lectern carrying case 140. The bottom side 11 of the first foam panel 10 is placed upon the floor. The second and third foam panels 20, 30 of the lower hinged sub-assembly 160 are then pivoted into an extended position, substantially as shown in FIG. 3, in perpendicular alignment with the back side 16 of the first foam panel 10. The left side 82 of the eighth foam panel 80 is then releasably secured to the top side 24 of the second foam panel 20, and the right side 83 of the eighth foam panel 80 is releasably secured to the top side 34 of the third foam panel 30, forming the table assembly 154 of FIG. 3.

The bottom face 76 of the seventh foam panel 70 may optionally be releasably secured to the top face 85 of the eighth foam panel 80. This provides a table assembly 154 having a larger top face.

The upper hinged sub assembly 162 is then positioned over the lower hinged sub assembly 160, with fourth foam panel 40 placed above the first foam panel 10. The fifth and sixth foam panels 50, 60 are then extended substantially perpendicular to the back face 46 of the fourth foam panel 40, and located above the second and third foam panels 20, 30.

When an eighth foam panel 80 is not used as a horizontal shelf and stiffening member, the bottom sides of the fifth and sixth foam panels 50, 60 are releasably secured directly to the top sides of the second and third foam panels 20, 30. When the eighth foam panel 80 is used, the bottom sides 54, 64 of the fifth and sixth foam panels 50, 60 are releasably secured to the left and right sides 82, 83 of the eighth foam panel 80.

The seventh foam panel 70 is then releasably secured to the inclined top sides 54, 64 of the fifth and sixth foam panels 50, 60, forming an inclined platform for the standup podium assembly 150, shown in FIG. 1 and FIG. 2.

Alternately, the upper hinged sub assembly 162 comprising the fourth, fifth and sixth foam panels 40, 50, 60 may be placed into an extended position upon a table, and the seventh foam panel 70 releasably secured to the inclined top sides of the fifth and sixth foam panels 50, 60 to form a tabletop lectern assembly 152, as shown in FIG. 4.

The fourth, fifth and six foam panels 40, 50, 60 may be releasably secured to the first, second and third foam panels 10, 20, 30 to form a full size, standing lectern assembly 150, as shown in FIG. 1 and FIG. 2. Where an eighth foam panel 80 is used, it is secured to the upper sides 24, 34 of the second and third foam panels 20, 30, and the bottom sides 51, 61 of the fifth and sixth foam panels 50, 60, to form a shelf extending between the second and third foam panels 20, 30.

Where an eighth foam panel 80 is used as a horizontal shelf 87, the left side 82 of the eight foam panel is releasably secured to the top side 24 of the second foam panel, and right side of the eighth foam panel is releasably secured to the upper side 34 of the third foam panel 30. Likewise, the left side 82 of the eighth foam panel 80 is releasably secured to the bottom side 52 of the fifth foam panel 50, and the right side 83 of the eighth foam panel 80 is releasably secured to the bottom side 62 of the sixth foam panel 60.

The left side 72 of the seventh foam panel 70 is then releasably secured to the inclined top side 54 of the fifth foam panel 50, and the right side 73 of the seventh foam panel is releasably secured to the inclined top side 64 of the sixth foam panel 60 with a releasable securement means 110. Once the combination foldable and separable lectern apparatus 100 is assembled as a standing lectern assembly 150, a table top lectern assembly 152 or a table assembly 154, it may easily be moved to a desired location, without the need for disassembly.

Where a stand or table assembly 154 is needed, such as for supporting a slide projector, overhead projector or movie projector, the second and third foam panels 20, 30 are extended substantially perpendicular to the back face 16 of the first foam panel 10, and the eighth foam panel 80 is releasably secured to the upper sides 24 and 34 of the second and third foam panels 20, 30, to form a horizontal shelf 87, as previously noted. The seventh foam panel 70 is may then optionally be releasably secured directly to the horizontal shelf 87, to provide additional strength and support during use, as shown in FIG. 3.

Where a table top lectern assembly 152 is needed, such as when addressing a group at a board room table, the fourth, fifth and six foam panels 40, 50, 60 are extended, and the seventh foam panel 70 is releasably secured to the inclined top side 54, 64 of the fifth and sixth foam panels 50, 60. This embodiment is not available where the top side 14 of the first foam panel 10 is optionally pivotally secured with a hinge means 90 to the bottom side 41 of the fourth foam panel 40, as shown in FIG. 4.

Thus the combination foldable and separable lectern apparatus 100 disclosed herein may be used as a full sized standup lectern assembly 150, a table top lectern assembly 152, or a table assembly 154, depending upon the needs of the user.

Figure 7:
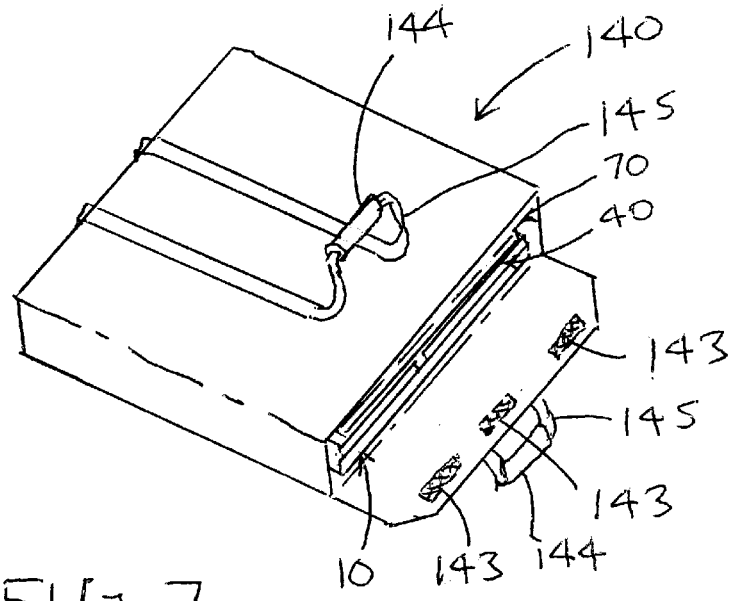
FIG. 7 is a perspective view of the lectern apparatus with the upper and lower sub-assemblies folded and inserted with the seventh and eighth foam panels into a lectern carrying case having handles.

As shown in FIG. 7, the combination foldable and separable lectern apparatus 100 may be folded compactly by reversing the procedure indicated above. Once folded, the lectern apparatus 100 may then be inserted into a suitable sized lectern carrying case 140, and secured within the lectern carrying case 140 with a releasable securement means 143, such as hook and loop type fastener, or a zipper (not shown). The lectern carrying case 140 is preferably made of a light weight flexible cloth or fabric material.

The handle portion 144 preferably extends in a loop above each side of the lectern carrying case 140. Preferably, the loop is formed by a strap 145 which extends across the entire height of the carrying case 140. When folded, the foldable lectern apparatus 100 is from twenty to thirty-six inches wide by twenty four to thirty six inches long, and from about one inch to six inches thick. The entire apparatus weighs only a few pounds, and is easy to transport, or store until needed.

Where the combination foldable and separable lectern apparatus 100 is to be used by a club, company or organization, indicia 132, such as a logo, drawing, company name or trademark or design, may be placed upon the front face 46 of the fourth foam panel 40, where it is easily seen by those gathered before the standup lectern assembly 150 or the table top lectern assembly 152.

When the front face 46 of the fourth foam panel 40 is optionally folded over the front face 15 of the first foam panel, the indicia 132 is protected during transport and storage.

The invention being thus described, it will be evident that the same may be varied in many ways. Such variations are not to be regarded as a departure from the spirit and scope of the invention, and all such modifications and variations are intended to be included within the scope of this disclosure, and the following claims.

FOLDABLE AND SEPARABLE LECTERN APPARATUS

PARTS LIST

| | |
|---|---|
| 10 | FIRST FOAM PANEL |
| 11 | bottom side |
| 12 | left side |
| 13 | right side |
| 14 | top side |
| 15 | front face |
| 16 | back face |
| 20 | SECOND FOAM PANEL |
| 21 | bottom side |
| 22 | left side |
| 23 | right side |
| 24 | top side |
| 25 | front face |
| 26 | back face |
| 30 | THIRD FOAM PANEL |
| 31 | bottom side |
| 32 | left side |
| 33 | right side |
| 34 | top side |
| 35 | front face |
| 36 | back face |
| 40 | FOURTH FOAM PANEL |
| 41 | bottom side |
| 42 | left side |
| 43 | right side |
| 44 | top side |
| 45 | front face |
| 46 | back face |
| 50 | FIFTH FOAM PANEL |
| 51 | bottom side |
| 52 | left side |
| 53 | right side |
| 54 | inclined top side |
| 55 | front face |
| 56 | back face |
| 60 | SIXTH FOAM PANEL |
| 61 | bottom side |
| 62 | left side |
| 63 | right side |
| 64 | inclined top side |
| 65 | front face |
| 66 | back face |
| 70 | SEVENTH FOAM PANEL |
| 71 | front side |
| 72 | left side |
| 73 | right side |
| 74 | back side |
| 75 | top face |
| 76 | bottom face |
| 77 | ridge |
| 78 | inclined top |
| 79 | offset edge |
| 80 | EIGHTH FOAM PANEL |
| 81 | front side |
| 82 | left side |
| 83 | right side |
| 84 | back side |
| 85 | top face |
| 86 | bottom face |
| 87 | horizontal shelf |
| 88 | offset edge |
| 90 | HINGE MEANS |
| 91 | first U-shaped member |
| 92 | first side |
| 93 | second side |
| 94 | back side |
| 95 | second U-shaped member |
| 96 | third side |
| 97 | fourth side |
| 98 | back side |
| 99 | pivoting member |
| 100 | foldable lectern apparatus |
| 101 | finished surface |
| 110 | RELEASABLE |

-continued

| | |
|---|---|
| FASTENING MEANS | |
| 111 | hook |
| 112 | loop |
| 114 | alignment pin |
| 116 | alignment aperture |
| 120 | U-SHAPED CHANNEL |
| 121 | first side |
| 122 | second side |
| 123 | back side |
| 124 | groove |
| 125 | fastening means |
| 126 | ridge extension |
| 130 | BRACKET |
| 140 | LECTERN CARRYING |
| CASE | |
| 141 | top portion |
| 142 | bottom portion |
| 143 | releasable securement |
| means | |
| 144 | handle |
| 145 | strap |
| 146 | indicia |
| 150 | Standup lectern assembly |
| 152 | Tabletop lectern assembly |
| 154 | table assembly |
| 160 | lower hinged assembly |
| 162 | upper hinged assembly |

I claim:

1. A combination foldable and separable lectern apparatus, which comprises:

a) a first foam panel having a left side, a right side, a bottom side, an upper side, a front face, and a back face;

b) a second foam panel having a left side, a right side, a bottom side, an upper side, a front face and a back face, the right side of the second foam panel pivotally secured to the left side of the first foam panel with a hinge means;

c) a third foam panel having a left side, a right side, a bottom side, an upper side, a front face and a back face, the left side of the third foam panel pivotally secured to the right side of the first foam panel with a hinge means;

d) a fourth foam panel having a left side, a right side, a lower side, and upper side, a front face and a back face;

e) a fifth foam panel having a left side, a right side, a lower side, an inclined upper side, a front face and a back face, the right side of the fifth foam panel pivotally secured to the left side of the fourth foam panel with a hinge means;

f) a sixth foam panel having a left side, a right side, a lower side, and an inclined upper side, a front face and a back face, the left side of the sixth foam panel pivotally secured to the right side of the fourth foam panel with a hinge means;

g) a releasable securement means for releasably securing the fifth foam panel to the second foam panel, and the sixth foam panel to the third foam panel; and h) a seventh foam panel having a front side, a left side, a right side, a back side, a top face and a bottom face, the length of the seventh foam panel sized to extend at least from the inclined top side of the fifth foam panel to the inclined top side of the sixth foam panel, the width of the seventh foam panel sized to be at least the width of the fifth foam panel, and the thickness of the seventh foam panel sized to be one to three times the thickness of the first foam panel; the left side of the seventh foam panel releasably secured to the inclined top side of the fifth foam panel, and the right side of the seventh foam panel releasably secured to the inclined top side of the sixth foam panel to form an inclined top surface therebetween; and the combination foldable and separable lectern apparatus may be selectively configured as one of a standup lectern assembly, a table top lectern assembly, and a table assembly.

2. The combination foldable and separable lectern apparatus of claim 1, wherein an eighth foam panel has a front side, a back side, a left side, a right side, a top face, and a bottom face, the length of the eighth foam panel sized to extend horizontally from the top side of the second foam panel to the top side of the third foam panel, the thickness of the eighth foam panel being from one to three times the thickness of the first foam panel, and the width of the eighth foam panel is similar to the width of the second foam panel, the eighth foam panel forms a shelf between the second and third foam panels, the left side of the eighth foam panel is releasably secured to the top side of the second foam panel, and the right side of the eighth foam panel is releasably secured to the top side of the third foam panel.

3. The combination foldable and separable lectern apparatus of claim 1, wherein the hinge means comprises a first U shaped channel having a first back portion with a first side portion and a second side portion depending in spaced, parallel relation from the first back portion, a second U-shaped channel having a back portion with a third side portion and a fourth side portion extending in spaced, parallel relation from the second back portion, and a pivoting member extending between the first back portion and the second back portion in proximity to the first side portion and the third side portion, and wherein the pivoting member is positioned to pivot between an extended position where the first back portion and the second back portion are substantially perpendicular to each other, and a closed position where the first side portion and the third side portion are substantially adjacent to each other.

4. The combination foldable and separable lectern apparatus of claim 1, wherein the bottom side of the first foam panel, the left side, bottom side and top side of the second foam panel, the right side, bottom side and top side of the third foam panel, the top side of the fourth foam panel, the lower side, left side and inclined top side of the fifth foam panel, and the right side, lower side and inclined top side of the sixth foam panel, are each secured to a respective U-shaped channel.

5. The combination foldable and separable lectern apparatus of claim 2, wherein the front side, left side, right side and back side of the seventh foam panel and the eighth foam panel are each secured to one of, an angle and a U-shaped channel.

6. The combination foldable and separable lectern apparatus of claim 5, wherein the front side of the seventh foam panel is secured to one of a U-shaped channel and an angle, and an upper lip which extends substantially the length of the seventh foam panel and further extends above the top face of the seventh foam panel to keep objects from falling off the inclined top face of the seventh foam panel.

7. The combination foldable and separable lectern apparatus of claim 1, wherein at least one of the front face and the back face of each of the respective foam panels is heated during molding to form a textured, finished surface.

8. The combination foldable and separable lectern apparatus of claim 1, wherein at least one of the front face and the back face of each of said foam panels is covered with a material selected from one of paper, cloth and plastic, and the material selected is adhesively secured to at least one of the front face and the back face of said foam panels.

9. The combination foldable and separable lectern apparatus of claim 1, wherein the releasable securement means is a hook and loop type releasable fastening means.

10. The combination foldable and separable lectern apparatus of claim 1, wherein the thickness of the first foam panel is sized to be from one-eighth of an inch thick to one inch thick, the width of the first foam panel is sized to be from sixteen inches wide to thirty-six inches wide, and the height of the first foam panel is sized to be from twenty-four inches high to thirty-six inches high; the thickness of the second and third foam panels is each sized to be similar to the thickness of the first foam panel, the width of the second and third panels is each sized to be equal to or slightly less than one half the width of the first foam panel, and the height of the second and third panels is each sized to be equal to, or up to one inch less than the height of the first foam panel.

11. The combination foldable and separable lectern apparatus of claim 1, wherein the thickness and width of the fourth foam panel is sized to be similar to the thickness of the first foam panel, and the height of the fourth foam panel is sized to be from ten inches high to twenty four inches high; the thickness and width of the fifth foam panel and the sixth foam panel are each sized to be similar to the thickness and width of the fourth foam panel, with the height of the inclined top surface of the fifth and sixth foam panels sized to be similar to the height of the fourth foam panel.

12. The combination foldable and separable lectern apparatus of claim 1, wherein the thickness of the seventh foam panel is sized to be from one to four times the thickness of the first foam panel, the width of the seventh foam panel is sized to be at least the width of the inclined top side of the fifth foam panel, and the length of the seventh foam panel is sized to be at least the length of the fourth foam panel plus twice the thickness of the fifth foam panel.

13. The combination foldable and separable lectern apparatus of claim 1, wherein the back face of the second foam panel and the back face of the third foam panel are each pivoted about said respective hinge means into an extended position perpendicular to the back face of the first foam panel, and at least one of the seventh foam panel and the eighth foam panel is secured to the top portions of the second and third foam panels with a releasable securement means to form a horizontal table configuration.

14. The combination foldable and separable lectern apparatus of claim 1, wherein the wherein the back face of the fourth foam panel and the back face of the fifth foam panel are each pivoted about said respective hinge means into an extended position perpendicular to the back face of the fourth foam panel, and the seventh foam panel is secured with a releasable securement means to the inclined top portions of the fifth and sixth foam panels to form an inclined table top podium configuration.

15. The combination foldable and separable lectern apparatus, of claim 1, wherein the top side of the first foam panel and the bottom side of the fourth foam panel are pivotally secured together with a hinge means.

16. The combination foldable and separable lectern apparatus of claim 1, wherein the second and third foam panels are folded adjacent to the first foam panel, the fourth and fifth foam panels are folded adjacent to the fourth foam panel, and the folded first through sixth foam panels, together with the seventh foam panel, are then placed within a carrying case having a handle for ease of transport and storage.

17. The combination foldable and separable lectern apparatus of claim 1, wherein indicia is positioned on the front face of the fourth foam panel, where it is visible to an audience when the combined foldable and separable lectern apparatus is configured in the standing lectern assembly configuration, and the table top assembly configuration.

18. A combination foldable and separable lectern apparatus, selectively configured to be a standup lectern assembly, a tabletop lectern assembly, and a table assembly, which comprises:

a) a first foam panel with a left side, a right side, a bottom side, an upper side, a front face, and a back face;

b) a second foam panel with a left side, a right side, a bottom side, an upper side, a front face and a back face, the right side of the second foam panel pivotally secured to the left side of the first foam panel with a hinge means;

c) a third foam panel with a left side, a right side, a bottom side, an upper side, a front face and a back face, the left side of the third foam panel pivotally secured to the right side of the first foam panel with a hinge means, the first, second and third foam panels forming a lower hinged sub-assembly;

d) a fourth foam panel with a left side, a right side, a lower side, and upper side, a front face and a back face, the lower side of the fourth foam panel pivotally secured to the upper side of the first foam panel with a hinge means;

e) a fifth foam panel with a left side, a right side, a lower side, an inclined upper side, a front face and a back face, the right side of the fifth foam panel pivotally secured to the left side of the fourth foam panel with a hinge means;

f) a sixth foam panel with a left side, a right side, a lower side, and an upper side, a front face and a back face, the left side of the sixth foam panel pivotally secured to the right side of the fourth foam panel with a hinge means, the fourth, fifth and sixth foam panels forming an upper hinged sub-assembly;

g) a seventh foam panel with a front side, a back side, a left side, a right side, a top face and a bottom face, the length of the seventh foam panel sized to extend at least from the inclined top side of the fifth foam panel to the inclined top side of the sixth foam panel, the width of the seventh foam panel sized to be at least the width of the fifth foam panel, and the thickness of the seventh foam panel sized to be one to three times the thickness of the first foam panel;

h) an eighth foam panel with a front side, a back side, a left side, a right side, a horizontal top face, and a bottom face, the length of the seventh foam panel sized to extend from the top side of the second foam panel to the top side of the third foam panel, the thickness of the eighth foam panel being from one to three times the thickness of the first foam panel, and the width of the eighth foam panel similar to the width of the fifth foam panel to form a shelf between the fifth foam panel and the sixth foam panel, the left side of the eighth foam panel releasably secured to the top side of the second foam panel and the right side of the eighth foam panel releasably secured to the top side of the third foam panel, and the left side of the eighth foam panel is also releasably secured to the bottom side of the fifth foam panel, and the right side of the eighth foam panel is releasably secured to the bottom side of the sixth foam panel, wherein the lower hinged sub-assembly and the eighth foam panel are joined together to form the table assembly;

the upper hinged sub-assembly and the seventh foam panel are joined together to from the tabletop podium assembly, and the lower hinged subassembly, the eighth foam panel, the upper hinged sub assembly and the seventh foam panel are joined together to form the standup podium assembly.

19. The combination foldable and separable lectern apparatus of claim 18, wherein the second and third foam panels are folded adjacent to the first foam panel, the fourth and fifth foam panels are folded adjacent to the fourth foam panel, and the first through sixth foam panels together with the seventh foam panel and the eighth foam panel are placed within a lectern carrying case having a handle for ease of transport and storage.

20. A combination foldable and separable lectern apparatus, which comprises:

a) a first foam panel having a left side, a right side, a bottom side, an upper side, a front face, and a back face;

b) a second foam panel having a left side, a right side, a bottom side, an upper side, a front face and a back face, the right side of the second foam panel pivotally secured to the left side of the first foam panel with a hinge means;

c) a third foam panel having a left side, a right side, a bottom side, an upper side, a front face and a back face, the left side of the third foam panel pivotally secured to the right side of the first foam panel with a hinge means, the first, second and third foam panels forming a lower hinged sub-assembly;

d) a fourth foam panel having a left side, a right side, a lower side, and upper side, a front face and a back face, the lower side of the fourth foam panel pivotally secured to the upper side of the first foam panel with a hinge means;

e) a fifth foam panel having a left side, a right side, a lower side, an inclined upper side, a front face and a back face, the right side of the fifth foam panel pivotally secured to the left side of the fourth foam panel with a hinge means;

f) a sixth foam panel having a left side, a right side, a lower side, and an upper side, a front face and a back face, the left side of the sixth foam panel pivotally secured to the right side of the fourth foam panel with a hinge means, the fourth, fifth and sixth foam panel, the fourth, fifth and sixth foam panels forming an upper hinged subassembly;

g) a seventh foam panel having a front side, a back side, a left side, a right side, a top face and a bottom face, the length of the seventh foam panel sized to extend at least from the inclined top side of the fifth foam panel to the inclined top side of the sixth foam panel, the width of the seventh foam panel sized to be at least the width of the fifth foam panel, and the thickness of the seventh foam panel sized to be one to three times the thickness of the first foam panel, and the left side of the seventh foam panel is releasably secured to the inclined top side of the fifth foam panel, and the right side of the seventh foam panel is releasably secured to the inclined top side of the sixth foam panel;

h) an eighth foam panel with a front side, a left side, a right side, a back side, a top face and a bottom face, the eighth foam panel forming a horizontal shelf extending between the upper portion of the second and third foam panels;

i) a releasable securement means for releasably securing the upper side of the second foam panel to the left side of the eighth foam panel, a releasable securement means for releasably securing the lower side of the fifth foam panel to the left side of the eighth foam panel, a releasable securement means for releasably securing the upper side of the third foam panel to the right side of the eighth foam panel, a releasable securement means for releasably securing the right side of the eighth foam panel to the lower side of the sixth foam panel; and j) the bottom side of the first foam panel, the left side, bottom side and top side of the second foam panel, the right side, bottom side and top side of the third foam panel, the top side of the fourth foam panel, the lower side, left side and inclined top side of the fifth foam panel, and the right side, lower side and inclined top side of the sixth foam panel, the front side, back side, left side and right side of the seventh foam panel, and the front side, back side, left side, and right side of the eighth foam panel are each secured to a respective U-shaped channel, and the lower hinged sub-assembly and the eighth foam panel are joined together to form the table assembly; the upper hinged sub-assembly and the seventh foam panel are joined together to from the tabletop podium assembly, and the lower hinged subassembly, the eighth foam panel, the upper hinged sub assembly and the seventh foam panel are joined together to form the standup lectern assembly.

* * * * *